US006427501B2

(12) United States Patent
Ramsauer

(10) Patent No.: US 6,427,501 B2
(45) **Date of Patent: *Aug. 6, 2002**

(54) SWIVELLING LEVER CONTROL THAT CAN BE LOCKED AFTER BEING SWIVELLED INWARDS AND FOR CLOSING SWITCHBOARD CABINET DOORS OR THE LIKE

(76) Inventor: Dieter Ramsauer, AM Neuhauskothen 20, D-42555 Velbert (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/254,214

(22) PCT Filed: Mar. 19, 1998

(86) PCT No.: PCT/EP98/01614

§ 371 (c)(1),
(2), (4) Date: Mar. 3, 1999

(87) PCT Pub. No.: WO99/01634

PCT Pub. Date: Jan. 14, 1999

(30) Foreign Application Priority Data

Jul. 4, 1997 (DE) ..... 297 11 741 U

(51) Int. Cl.[7] ..... E05B 13/10

(52) U.S. Cl. ..... 70/208; 70/215; 292/336.3; 292/DIG. 31

(58) Field of Search ..... 70/208, 210–212, 70/215; 292/200, 336.3, DIG. 31

(56) References Cited

U.S. PATENT DOCUMENTS

| | | | | | |
|---|---|---|---|---|---|
| 2,533,360 | A | | 12/1950 | Dath | |
| 4,365,831 | A | * | 12/1982 | Bourne | 292/210 X |
| 5,440,905 | A | * | 8/1995 | Yamada | 70/208 |
| 5,450,734 | A | * | 9/1995 | Esaki et al. | 70/208 |
| 5,457,971 | A | * | 10/1995 | Yamada | 70/208 |
| 5,469,725 | A | * | 11/1995 | Yamada | 70/208 |
| 5,620,213 | A | | 4/1997 | Ellis | 292/210 |
| 5,638,709 | A | * | 6/1997 | Clavin | 70/208 |

FOREIGN PATENT DOCUMENTS

| | | |
|---|---|---|
| DE | 90 12 372.7 | 1/1992 |
| DE | 42 22 415 | 1/1993 |
| DE | 94 11 009 | 10/1995 |
| EP | 0 261 266 | 3/1988 |
| GB | 2 275 735 | 9/1994 |

* cited by examiner

*Primary Examiner*—Lloyd A. Gall
(74) *Attorney, Agent, or Firm*—Reed Smith LLP

(57) ABSTRACT

A swivelling lever control that can be locked after being swiveled inwards and for closing switchboard cabinet doors has a trough set on the outer surface of a door, in which the driving device for the closure, such as gear drive, lever drive or locking shaft, is arranged. An actuating lever is articulated to the driving device so as to swivel out of the trough about an axis parallel to the supporting surface of the trough. A hook device on the actuating lever engages a back engagement surface of the trough when the actuating lever is swiveled in, thus retaining the actuating lever after it has been swiveled into the trough. The actuating lever projects at its free end beyond the trough and bears an unlocking device with an actuating surface for the hook device that can be actuated by a pressure acting away from the outer surface of the door.

12 Claims, 13 Drawing Sheets

SWIVELLING LEVER CONTROL THAT CAN BE LOCKED AFTER BEING SWIVELLED INWARDS AND FOR CLOSING SWITCHBOARD CABINET DOORS OR THE LIKE

BACKGROUND OF THE INVENTION

1. Technical Field

The invention is directed to a swivel lever actuator which can be secured in the swiveled in state for the closure of switch cabinet doors or the like, with a trough or dish which is arranged on the outer surface of the door or the like and in which is arranged the driving device for the closure, such as a toothed-wheel drive, lever drive or lock shaft, wherein an actuating lever is articulated at the driving device so as to be swivelable out of the dish about an axis extending parallel to the supporting surface of the dish on the door or the like, and with a finger lever which is mounted on the actuating lever so as to be swivelable, wherein a hook is arranged at one end of the finger lever in such a way that when the actuating lever is swiveled into the dish the hook engages behind a step of the dish and accordingly prevents the actuating lever from swiveling out, and with an actuating surface arranged at the other end of the finger lever, wherein the hook moves out of its back-engagement position when the actuating surface is pressed.

2. Description of the Related Art

A swivel lever actuator of the type mentioned above is already known from U.S. Pat. No. 5,467,623 (Takigen). A disadvantage in this known arrangement is that the actuating surface must always be pressed in the direction of the door leaf in order to cancel the locking achieved by the hook and so as to be able to swivel the hand lever out of its swiveled in position, i.e., it is disadvantageous that unlocking (pressing) conflicts with the swiveling out, that is, the pulling, of the actuating lever.

It is also possible to arrange the finger lever in such a way that the pressing direction coincides with the opening direction of the actuating lever when the latter is actuated.

Therefore, in the arrangement according to the prior art, it is compulsory that the swiveling out of the actuating lever is reinforced by a powerful pressure spring, while the actuation of the finger lever must be carried out against the force of a spring with relatively little resistance so that the two spring actions do not conflict with one another.

OBJECT AND SUMMARY OF THE INVENTION

It is the primary object and summary of the invention to further develop the known arrangement such that the finger lever can be actuated in such a way that the swiveling out of the actuating lever is not impeded by the unlocking process.

In the prior art, the actuating lever can be additionally locked by means of a cylinder lock. This should still be possible. An additional locking of this kind is advantageous when the swivel lever closure may be exposed to strong vibrations. Such strong vibrations are possible, for example, through the effect of earthquakes or when the closure devices are arranged on switch cabinets that are arranged on machines which vibrate heavily during operation, for example, in crane installations.

Further, the arrangement should be capable of being rearranged in such a way that a padlock can be inserted.

This object is met in that the free end of the actuating lever projects over the dish and/or has unlocking means with an actuating surface for the hook device, which unlocking means can be actuated by pressure directed away from the outer surface of the door. In particular, it is advantageous when the finger lever projects over the free end of the actuating lever and has an actuating surface which faces in the swiveling in direction of the actuating lever.

By means of these features, it is possible to actuate the finger lever in such a way that, when actuated, the pressing action not only cancels the locking of the finger lever, but at the same time also reinforces the swiveling out movement of the actuating lever out of its swiveled in position or this movement can be reinforced manually.

BRIEF DESCRIPTION OF THE DRAWINGS

The invention will be described more fully hereinafter with reference to embodiment examples shown in the drawings.

DESCRIPTION OF THE PREFERRED EMBODIMENTS

Figure 1:
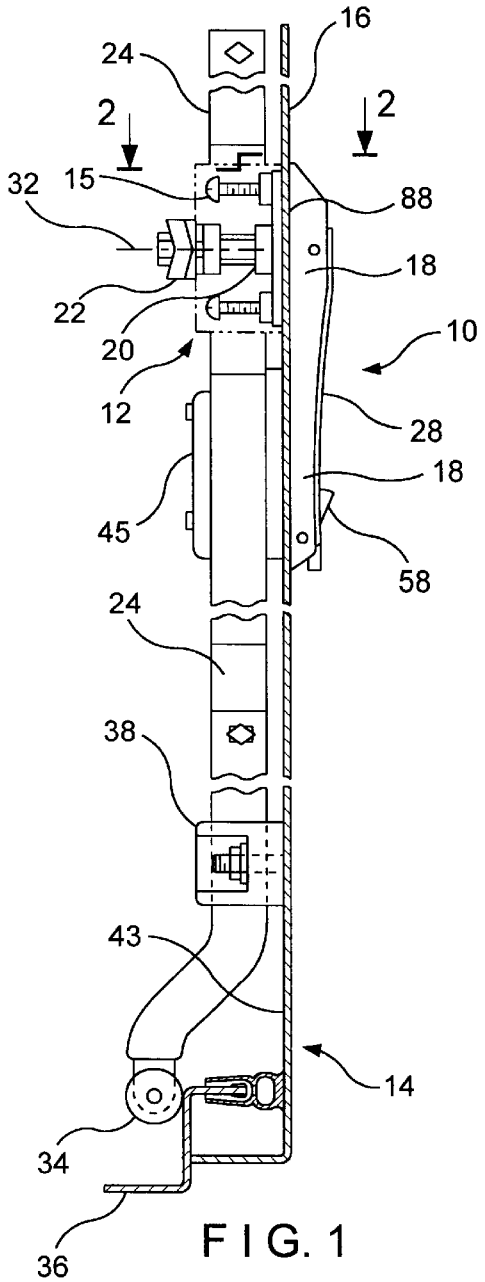
FIG. 1 is a side view of a lockable swivel lever actuator constructed according to the invention for the closure of a switch cabinet door, in this case in connection with a flat rod closure installed in a switch cabinet.
Figure 3:
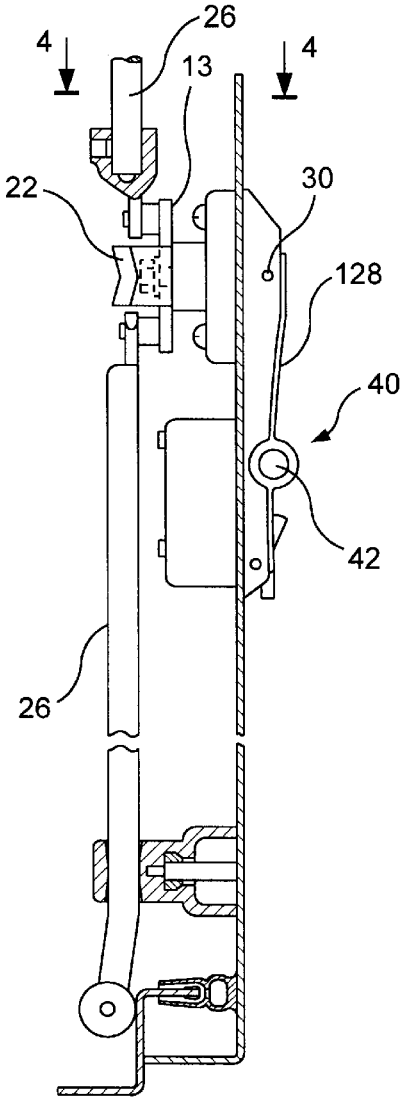
FIG. 3 shows the swivel lever actuator shown in FIG. 1, but, in this case, in connection with a round rod closure and with an additional securing device through which a padlock can be inserted.

FIG. 1 is a side view showing a swivel lever actuator 10 for the closure 12 of a switch cabinet door 14, a housing wall, sheet-metal case cover or the like, with a dish 18 which is arranged on the outer surface 16 of the switch cabinet door 14 or the like and in which is arranged a lock shaft 20 which drives, for example, a sash 22 in a manner not shown more fully and also, in this case, flat strip locking rods 24 (FIG. 1) extending along the door leaf or, in accordance with FIG. 3, round rods 26. For further details in this connection, reference is had to the European Patents 0 054 225 and 0 261 267.

Figure 2:
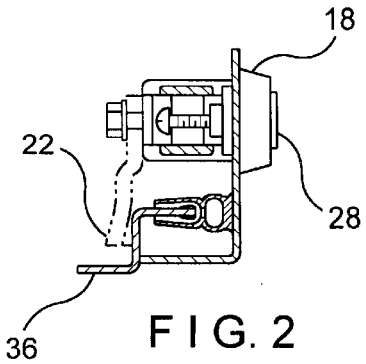
FIG. 2 shows a cross-sectional view through the arrangement according to FIG. 1 along line II—II of FIG. 1.
Figure 4:
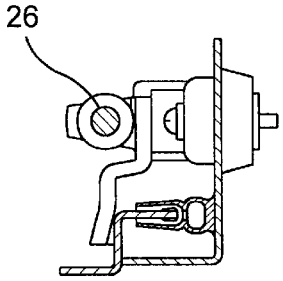
FIG. 4 shows a cross-sectional view through the closure according to FIG. 3 along section line IV—IV in FIG. 3.
Figure 26:
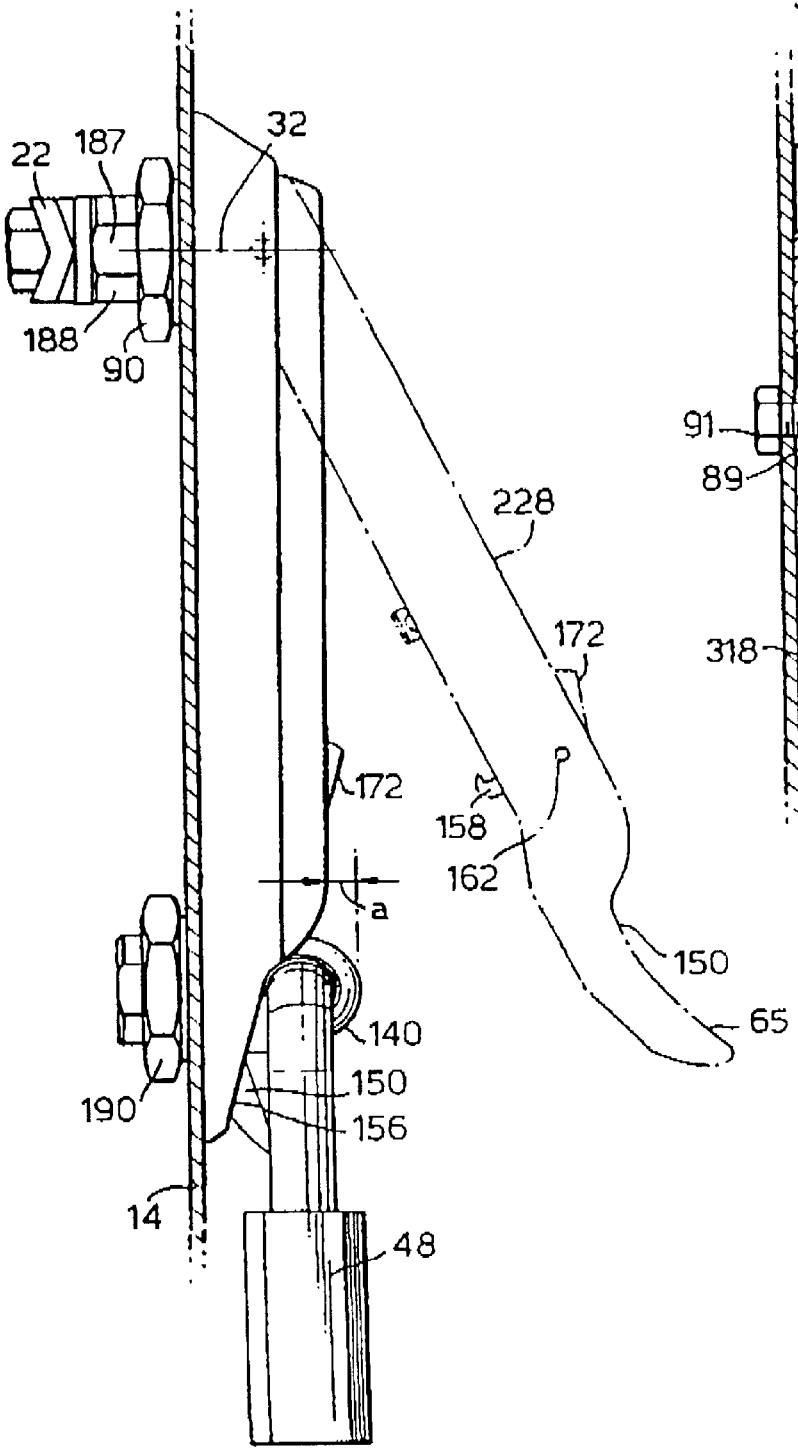
FIG. 26 shows a side view of the arrangement according to FIG. 24 in which the swiveled out as shown by dashed lines.

An actuating lever 28 is articulated at the free end of this lock shaft 20 directed away from the sash so as to be swivelable out of the dish 18 about an axis 30 extending transverse to the axis of the shaft 20. In the swiveled out state which is shown in dashes in FIG. 26, the shaft 20 can be rotated with the actuating lever 28 about its axis 32, for example, in order to swivel a sash 22 behind the door frame 36 (see FIG. 2) of a switch cabinet, not shown, and accordingly to close the door. Alternatively or in addition, a door closure position is achieved, as shown in FIG. 1, by flat strip rods 24 which can be moved upward and downward, wherein a stop wheel 34 runs up on the edge, shown in FIG. 1, of a switch cabinet housing and holds the door leaf 14 at which the locking rod 24 is guided by means of rod guides 38. In the embodiment forms shown in FIGS. 1 and 3, the locking rods 24 are located in the locked position in which the actuating lever 28 faces downward as can also be seen in FIG. 26. In this position, the actuating lever 28 can be swiveled into the dish 18, in which position the actuating lever 28 is substantially enclosed by the dish edges. The devices described in the following should serve to hold the actuating lever in this swiveled in position in which the actuating lever 28 is prevented from being rotated out of its position oriented to the dish due to the fact that it is enclosed by the dish edges. Therefore, it is not possible for the door to be opened in this position.

When the actuating lever 28 is in its position in which it is directed vertically downward, its own gravitational force and friction are sufficient in themselves to hold it in this position. However, during shaking movements such as those which can occur, for example, in crane installations, there is a risk that the actuating lever 28 will move out of its swiveled in position again and into the swiveled out position shown in dashed lines in FIG. 26. In this position, rotation can also be effected about axis 32 due to further shaking movement, so that the closure 12 opens in certain cases and therefore exposes the interior of the switch cabinet in an unwanted manner. It is also possible for an unauthorized person to swivel out the actuating lever 28 and move the door closure out of its closed position into an open position by rotating about the axis 32, thereby making it possible to open the door 14 of the switch cabinet.

Figure 5:
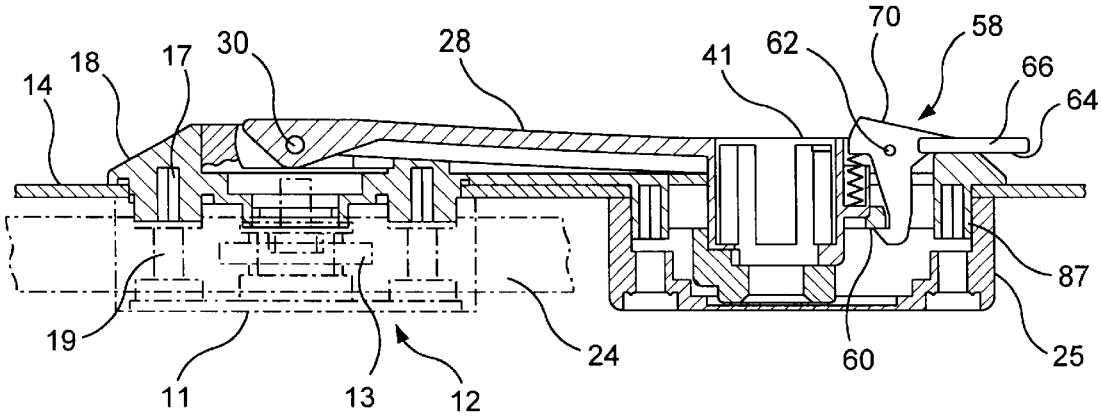
FIG. 5 shows a sectional side view (approximately to scale) of a swivel lever actuator similar to that shown in FIG. 1.
Figure 6:
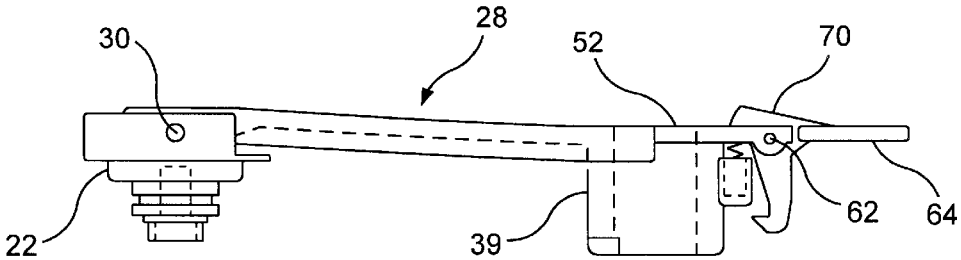
FIG. 6 shows a side view of the swivel lever of the arrangement in FIG. 5.

In order to prevent this, a protrusion 39 can be provided at the free end of the hand lever 28 according to FIG. 6, wherein a cylinder lock 41 can be received in the protrusion 39 (see FIG. 5). The locking member of the corresponding cylinder can be mounted in such a way that it contacts a rear surface of the door leaf 14 in the locked state when the hand lever 28 is swiveled in and accordingly prevents the hand lever 28 from being swiveled out of its swiveled in position in an unwanted manner.

Alternatively, a locking member of the kind mentioned above can also lie behind a contact surface formed by a screwed on casing 45. However, it cannot necessarily be seen whether or not the cylinder 49 is locked, i.e., it becomes more difficult to monitor the locking state. In order to provide additional or alternative locking, there is a projection 40 which is supported by the dish 118 (see FIG. 3 and FIG. 22), wherein an eyelet 42 is arranged at the free end of the projection 40. When the actuating lever 128 is swiveled in, this eyelet extends through an opening 44 in this hand lever and makes it possible to insert the shackle 46 of a padlock 48, which also prevents the hand lever 128 from swiveling out of its swiveled in position.

The great advantage in securing by means of a padlock 48 consists in that an individual padlock 48 belonging to a certain person can be used, for example, at certain times and for certain reasons, so that it is possible for this person to secure a door against unauthorized opening. Only this person can open the padlock again by means of the appropriate key, remove the padlock, and then open the door closure by folding out and subsequently turning the actuating lever.

However, it may be that a special locking of this kind by means of a padlock or a cylinder lock is not required at certain times. In order for the actuating lever to be held in the swiveled in position in this case, a hook device 58 is provided, according to the invention, at the swivel lever 128, which hook device 58 engages with a back-engagement surface 60 of the dish 18 when the actuating lever 128 is swiveled in, thereby holding the actuating lever 128 in the swiveled in position. The hook 58, which in this case is held so as to be swivelable about an axis 62 formed by the actuating lever 128, has a first actuating surface 64 which projects over the end of the actuating lever 128 and which is directed in such a way that the user must grasp this surface 64 under the lever 66 corresponding to an opening movement of the hand lever 128 in order to swivel the hook 58 out of its locked position (in the counterclockwise direction with reference to FIGS. 5, 6, 8 and 9), wherein this pulling direction not only swivels the hook 58 out of its locking position, as is shown in FIG. 9, but also subsequently pulls the actuating lever 128 out of its swiveled in position after the hook is undone. This operating sequence is intuitive for the user and therefore represents a particularly advantageous embodiment form of this hook device 51.

However, by means of a second actuating surface 70 which is provided in this instance and which projects beyond the plane 52 of the actuating lever 28, the hook 58 can also be swiveled out of its locking position by a pressing movement in the direction of the hand lever surface 52. Further, the additional lever arm forming this actuating surface 70 has, on its back, a recess 72 in which one end of a pressure spring 68 is received, while the other end of the pressure spring 68 is held in a recess 74 which is formed inside the actuating lever 128.

Figure 21:
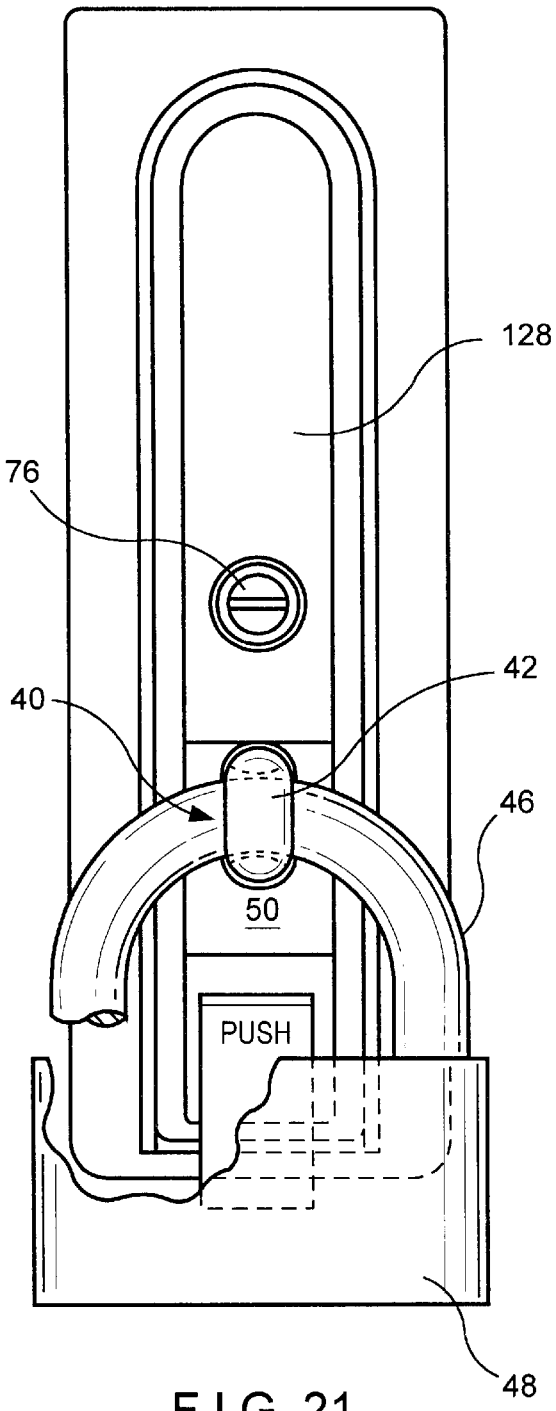
FIG. 21 shows a front view of the swivel lever actuator according to FIG. 20 with inserted padlock.
Figure 22:
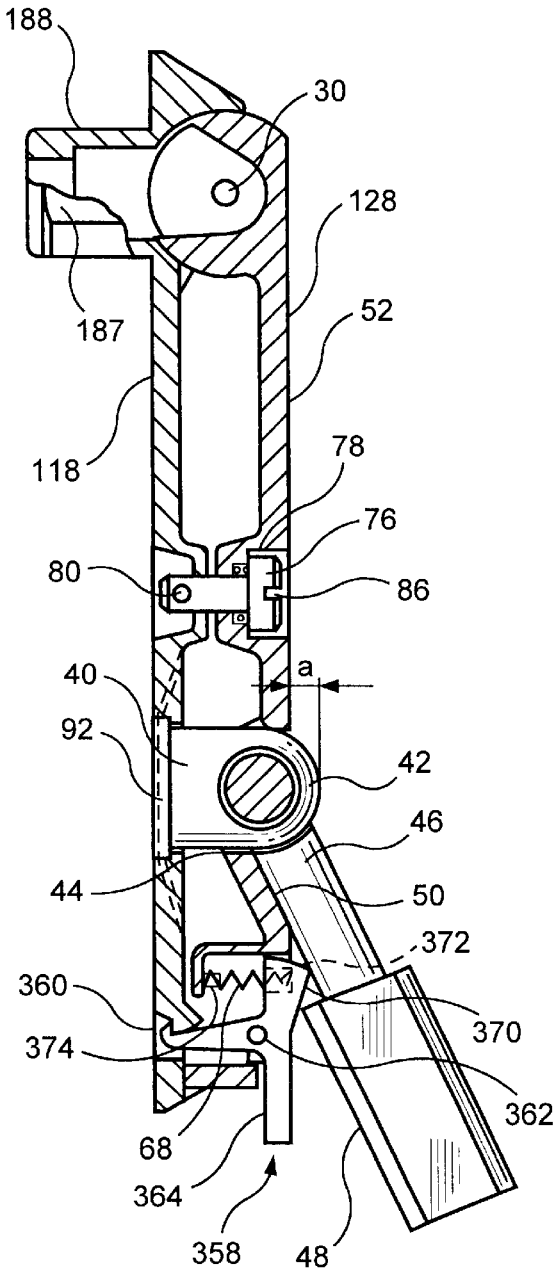
FIG. 22 shows a side view, in section along the longitudinal axis, of the swivel lever actuator according to FIG. 21.
Figure 23:
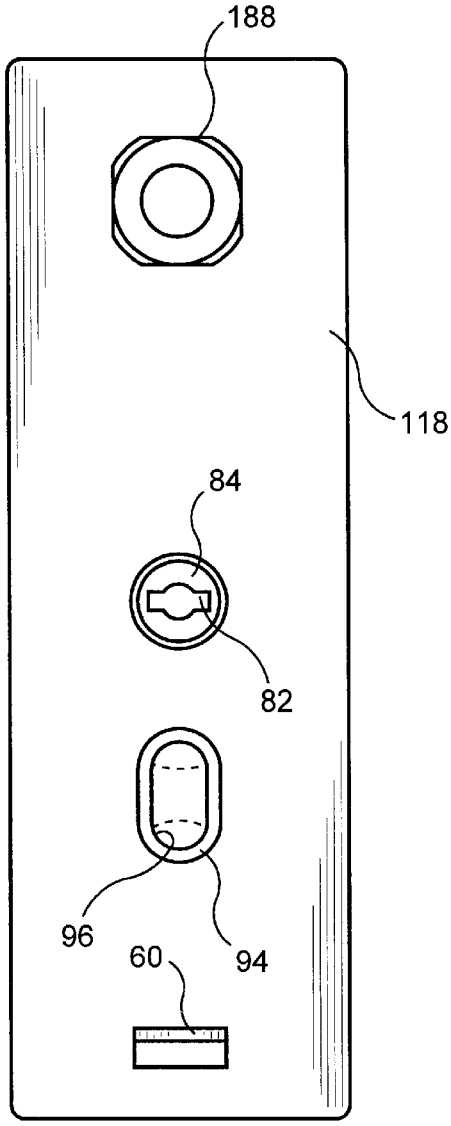
FIG. 23 shows a rear view of the dish of the arrangement according to FIG. 21.

The actuating lever 128 can be provided with an additional spring device in the area of its axis 30, as in the prior art, in order to move the actuating lever 128 out of its swiveled in position automatically when required. In this case, when the actuating surface 70 of the hook device 58 is pressed, this hook is released and the spring action presses the actuating lever out of its swiveled in position insofar as it is not held by the cylinder lock 41 or by an inserted padlock 48 according to another embodiment form. This other embodiment form is shown, for example, in FIG. 21 in a top view, in FIG. 22 in a longitudinal sectional view, and in FIG. 23 in a rear view. Further, FIGS. 21, 22 and 23 show an additional locking possibility. This relates to a head pin 76 which is arranged approximately in the center of the actuating lever 128 and which may be mounted so as to be rotatable in a countersunk opening 78 of the actuating lever 128. The free end of the pin 76 has a cross-pin 80 which can be received in a determined position of the head pin 76 when the actuating lever 128 is swiveled into an opening 82 of the dish 118. The area of the dish 118 forming this opening 82 juts out somewhat so that back-engagement surfaces 84 are formed, wherein the ends of the pin 80 lie behind these back-engagement surfaces 84 when the head pin 76 is rotated by 90°. Accordingly, this is a kind of quarter-turn closure which makes it possible to lock the actuating lever 128 in its swiveled in position by means of this head pin 76. A torque spring provides for automatic locking, and opening is carried out against spring pressure by a screwdriver (or a socket wrench if the head is shaped differently). The rotation of the head pin 76 into and out of the locking position can be carried out by means of a tool, in this case, a screwdriver, not shown, which is inserted into a slot 86 of the head pin 76. However, this purpose can also be met by a bar or a swivelable tongue when it can be moved against spring force by a cam or a connection which is rigid with respect to rotation, possibly with freewheeling.

According to FIGS. 1 and 3, the dish has a protrusion 88 which extends through the door leaf 16 where it is part of a lock shaft support and, e.g., according to FIG. 1, communicates with a lock case, wherein the door leaf 16 is clamped between the lock case and the dish 18 so that the dish is held firmly. The opening provided in the door leaf for this purpose is rectangular in this case, similar to that required in the construction according to the above-cited European Patent 0 261 267.

According to FIG. 3, a construction is provided in which a disk 13 is provided instead of a lock case, wherein the sash tongue 22 on the one hand and projections for the articulation of the round rods 26 on the other hand proceed from this disk 13.

In the lock case 11 (which is constructed in a two-part manner in this instance), there is mounted a pinion which drives the driving rods 24 and which is driven in turn by the lock shaft 20 at which the actuating lever 28 is articulated such that it can swivel out (see FIG. 6). According to the present embodiment form, the lock case 11 is fastened to the dish 18 by means of screws 15 which project freely through openings 19 formed by the lock case 11 and which are then screwed into somewhat narrower bore holes 17 formed by the dish 18. The dish material is usually made of plastic, so that it is possible to cut a thread into the bore hole 17 with appropriately shaped fastening screws, so that it is not necessary to insert threaded bore holes beforehand.

When the lock case 11 is securely screwed to the dish 18, the edge area of the opening is clamped in the door leaf as can be seen in FIG. 5. Similarly, the protrusion 87 of the dish 18 extending through the door leaf 14 is enclosed at the other end of the dish by means of a cover 25, wherein the protrusion 87 also forms the above-mentioned back-engagement surface 16 for the hook device 58. Openings 19 are also provided in the cover 25, wherein fastening screws can be inserted through the openings 19 so as to dig into the bore holes 17 of the dish 18 so that the cover can be fastened to the dish 18. In this connection, the edge area of the opening is again clamped in the door leaf 14 between the edge or end face 27 of the cover 25 and the shoulder 29 of the dish 18 which projects out in the manner of a flange, so that the entire arrangement is securely held.

It is further noted that the head of the fastening screw 15, not shown in FIG. 9, can be received within a recess 31 formed by the cover 25 or by the lock case 11; annular protrusions 33 on which the support surface of the screw head is supported and forms a seal can also be seen in the area of this recess 31.

Figure 8:
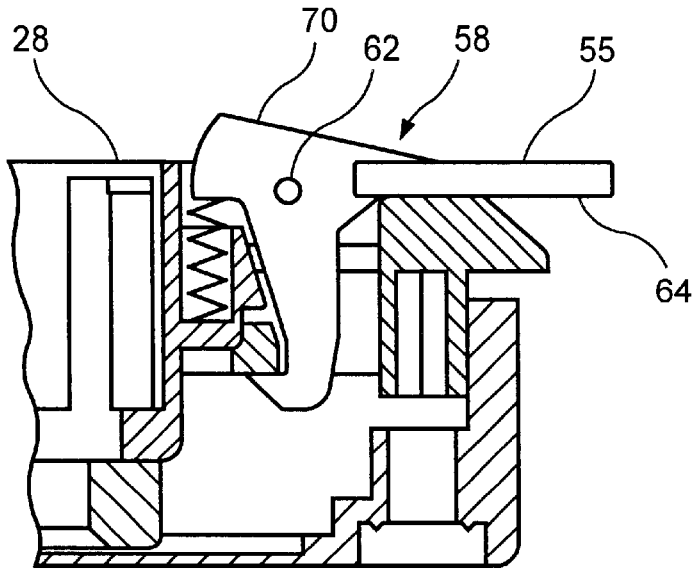
FIG. 8 shows an enlarged detail of the locking device of the arrangement shown in FIG. 5 in the locked position.
Figure 9:
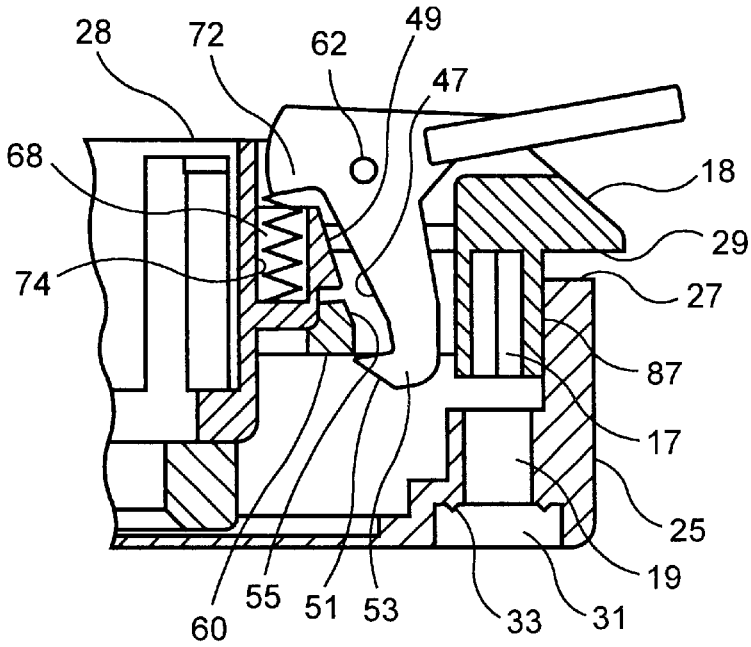
FIG. 9 shows a view similar to that in FIG. 8 of the locking device in the unlocked position.
Figure 10:
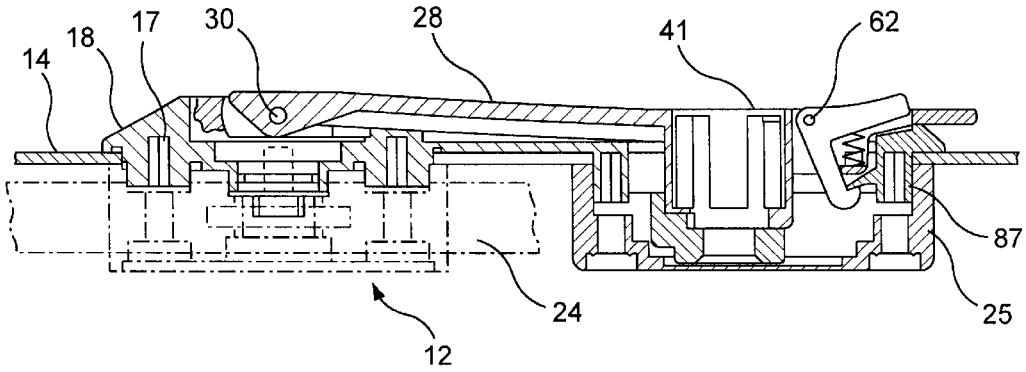
FIGS. 10 to 14 show another embodiment form of the invention in views similar to those in FIGS. 5 to 9.
Figure 11:
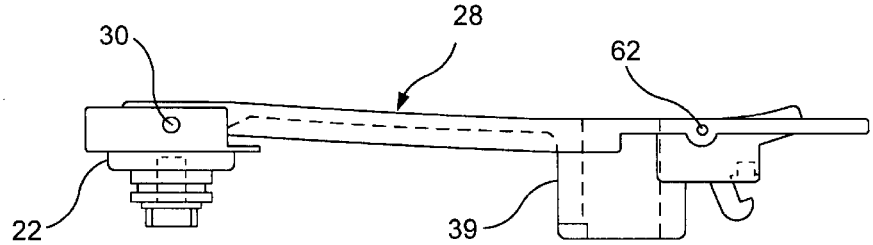
Figure 12:
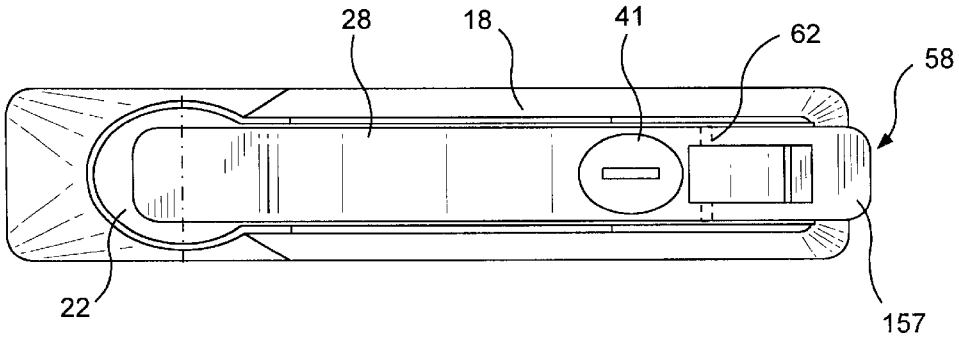
Figure 13:
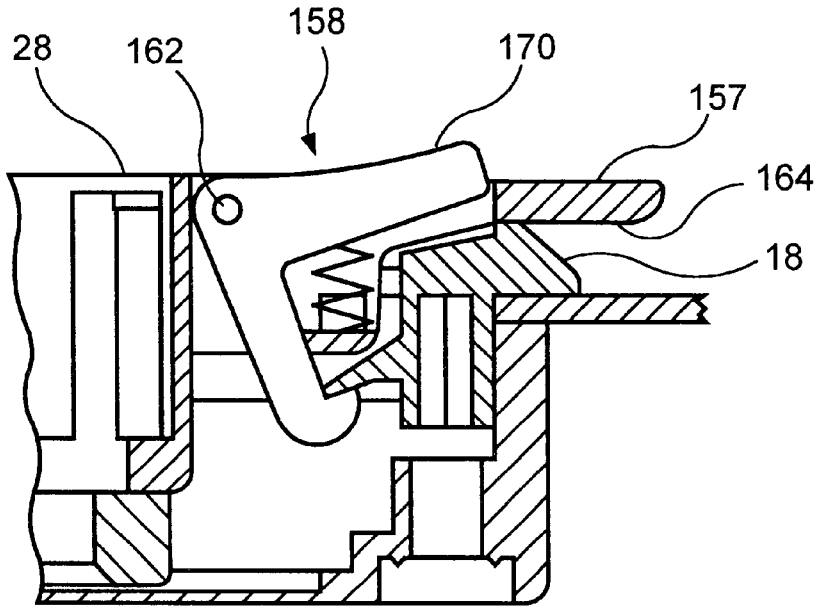
Figure 14:
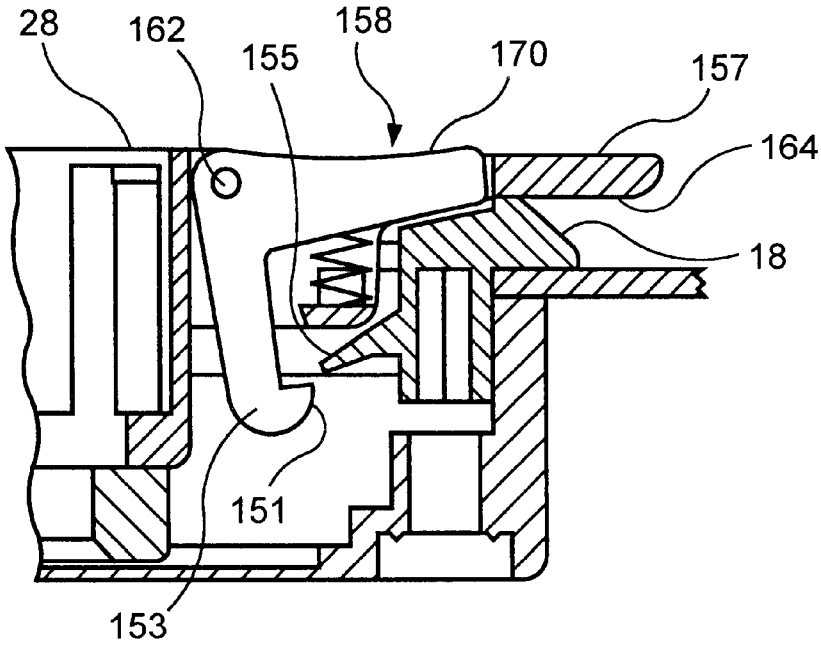
Figure 15:
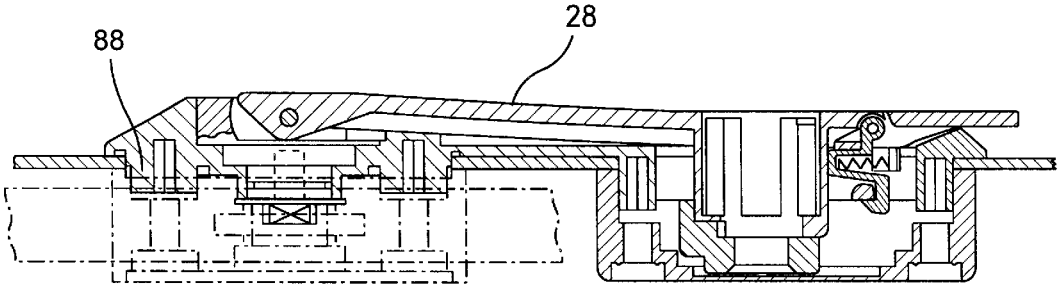
FIGS. 15 to 19 show another embodiment form in a corresponding manner.
Figure 16:
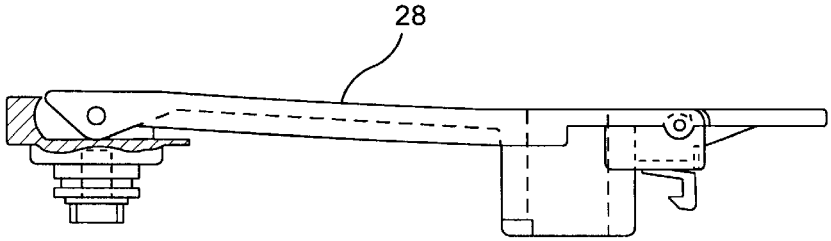
Figure 17:
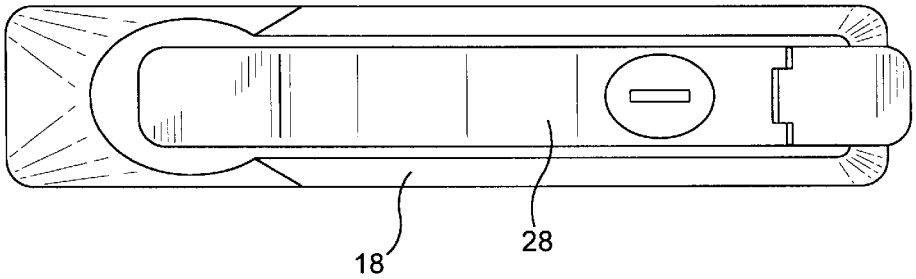
Figure 18:
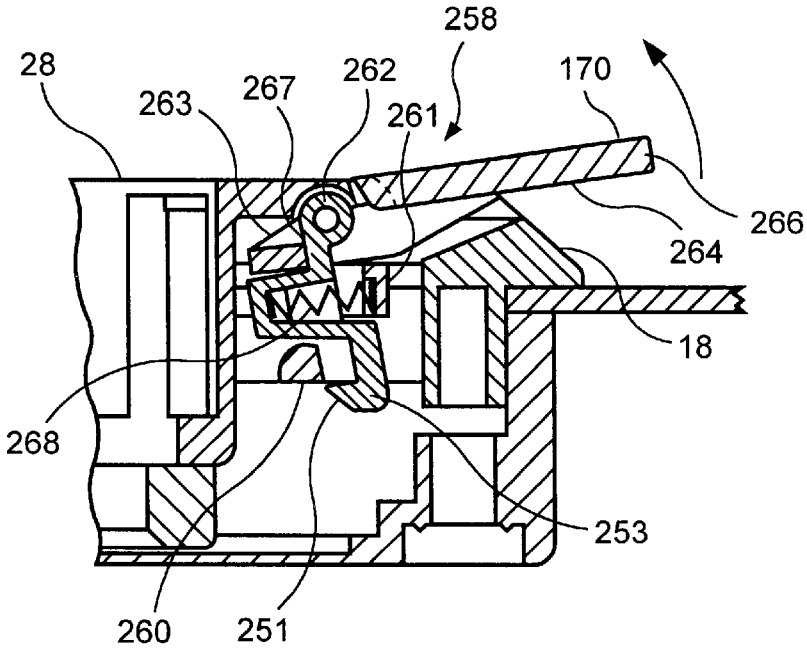
Figure 19:
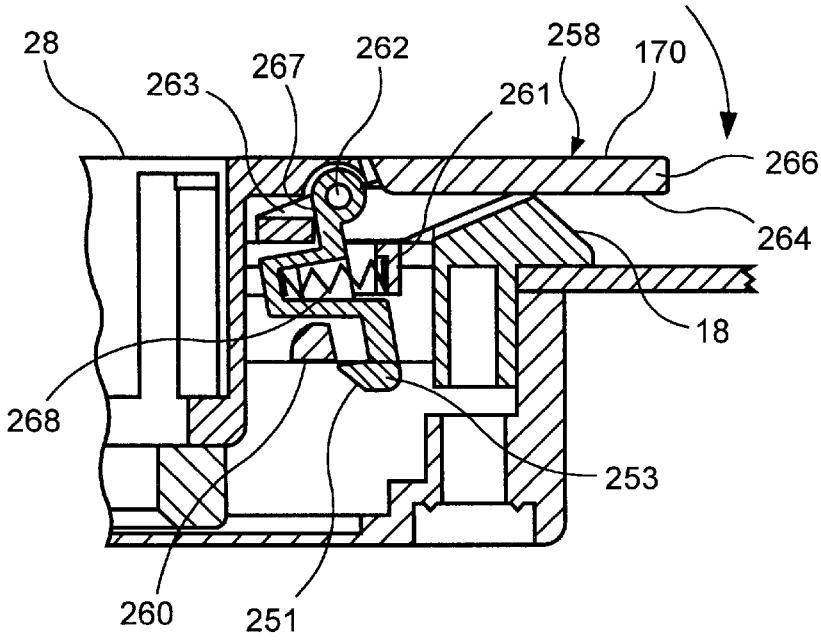
Figure 20:
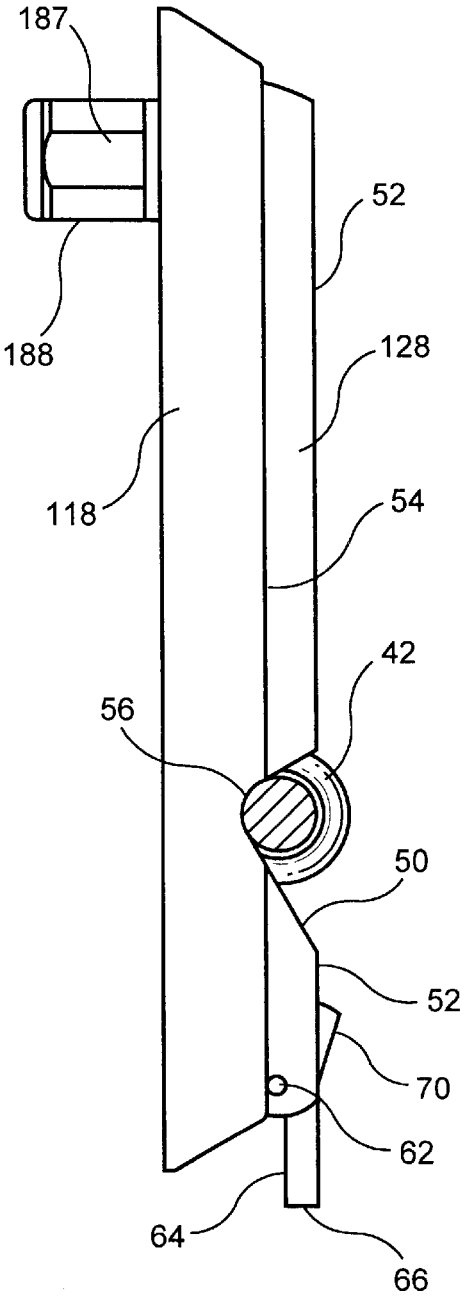
FIG. 20 shows a side view of a swivel lever in which is provided an eyelet enabling an additional locking by means of a padlock.

While FIG. 8 shows the hook device 58 in the closed state, FIG. 9 shows the arrangement after the user has grasped the user surface 64 and accordingly swiveled the actuating hook 58 in the counterclockwise direction. In this way, the hook is released from the back-engagement surface 60 of the dish 18 and the actuating lever 28 can therefore be swiveled up out of the dish. When the user lets go of the actuating device, the pressure spring 68 presses against the spring receptacle 72 of the hook device 58 and rotates the latter about axis 62 in the clockwise direction until the surface 47 of the hook device 58 abuts against the stop surface 49 of the dish 18.

When moved in the opposite direction, i.e., when the hand lever 28 is pressed into the dish, a diagonal surface 51 of the hook end 53 encounters the diagonal surface 55 of the dish 18, so that the hook device 58 is again swiveled in the counterclockwise direction about axis 62 until the hook end 58 moves into the back-engagement position 60 and the hook is moved in the clockwise direction and is locked. It has then returned to the position shown in FIG. 8.

Figure 7:
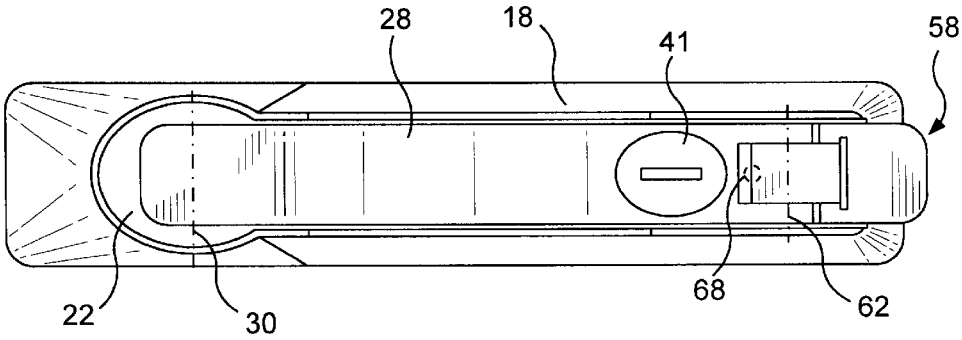
FIG. 7 shows a top view of the arrangement according to FIG. 5.

FIG. 7 shows how the hook device 58 which is swivelable about axis 62 is engaged by the free end of the actuating lever 28 in a U-shaped manner so that a particularly secure support is made possible.

The embodiment form shown in this case requires that the hook device 58 can move freely when the actuating lever 28 is pressed into the dish, that is, for example, so that the actuating lever 28 is not pressed in as the result of pressing on the surface 55 of the hook device 58. In this case, it could happen that the diagonal surface 51 of the hook does not clear the diagonal surface 55 of the dish because it is unable to deflect in the counterclockwise direction due to the pressure on the surface 55.

On the other hand, the user tends to grasp the actuating lever 28 at its free end and press it into the dish. The embodiment form shown in FIGS. 10 to 14 more closely accounts for this situation.

According to FIGS. 10 to 14, the end 157 of the hand lever 28 is fixedly connected with the hand lever 28 and thus does not influence the movement of the hook device 158. Therefore, in this embodiment form, the hand lever can be grasped at its free end 154 and pressed into the dish without the sliding movement of the diagonal surfaces 151 of the hook end 153 along the diagonal surface 155 of the dish 18 being impeded by the pressing forces acting on the hook device 158. On the contrary, if the user's thumb were to slide over the surface of the end 157 of the hand lever 128 in the direction of the pressing surface 170, the deflecting movement would even be reinforced.

Similarly, it is also possible in this case to carry out unlocking in a simple manner, although an actuating surface facing the door handle surface is not available for the hook device 158 in this embodiment form. Instead, a pulling surface 164 is provided which can simultaneously pull the actuating lever 128 out of its swiveled in position, namely, for example, with the surface of the index finger, when the surface 170 is actuated, e.g., by means of the user's thumb. That is, in this case, the close spatial relationship between the pulling surface 164 and the pressing surface 170 makes it possible to achieve the action, according to the invention, by which the swivel lever 128 can be unlocked and also pulled out of its swiveled in position by one hand action. This is not possible in the prior art.

Another even more advantageous embodiment form is shown in FIGS. 15 to 19, in which the hook device 258 is arranged in such a way that a freewheeling action results. The hook end 253 and hook swivel axis 262 are arranged at approximately the same point as shown in the embodiment form according to FIG. 8. The pressure spring 268 is accommodated in a pocket which is formed in the hook device and in which one end is supported, while the other end of the pressure spring 268 is supported at a contact surface formed by the dish 18. The lever 266 forming the pressing surface 170 forms a back-crosspiece 263 which contacts the surface 267 of the hook device 258 when lifting by means of pressing on the surface 264 of the lever 266 and swivels the hook device 258 in the counterclockwise direction about the shaft 262.

When the swiveled out actuating lever 28 is swiveled into the dish 18 again, the diagonal surface 251 of the hook end 253 can slide along the diagonal surface 260 of the dish 18 and, in so doing, swivel the hook 263 in the counterclockwise direction without also having to swivel up the lever 266. Rather, at this instant, the surface 267 is lifted from the crosspiece 263 as can be seen from FIG. 19, so that pressure exerted on the surface 170 for closing the hand lever does not cause a problem.

The embodiment forms shown in FIGS. 1 to 19 are installed in a door leaf which has two substantially rectangular openings that are preferably arranged symmetric to the center of the door. In the embodiment form according to FIGS. 21 to 24, the dish 118 shown therein has a projection 188 having a circular outer cross section and an external thread, possibly with flattened portions 187, so that the projection 188 can be used in circular openings in sheet-metal cabinet doors, which circular openings are provided with corresponding necked down portions. A fastening screw (cap nut or union nut) can then be placed on the projection 188 and the door leaf can be clamped between this nut and the dish support surface 118 as is shown in FIG. 25.

FIGS. 20 to 23 show an example of how the arrangement according to the invention can be connected with a swivel lever that is lockable by means of a padlock. The eyelet 42 provided for the padlock 48 is carried by a projection 40 which can be formed integral with the dish 118, but which, for purposes of strength (e.g., when the dish is made of plastic), can also be constructed in such a way that this projection 40 is a separate structural component part which is made of metal and has a base plate 92. This base plate can be inserted into a corresponding recess 94 of the dish 118 from the rear in such a way that its surface area is aligned with the surface area of the dish 118 as can be seen in FIG. 22. The edges of the base plate are then held by the protrusions 96 of the dish 118. Alternatively, the projection 40 could also be injected into the material of the dish 118.

The padlock 48 shown in FIG. 22 projects out diagonally, so that the lock is more easily accessible. On the other hand, this lock 48 does not impede access to the hook device 358 because prior to the actuation of this hook device 358 by pressing on surface 364 or surface 370 this padlock is removed in any case in order to make it possible to swivel out the swivel lever 128 at all.

But in case this jutting out of the lock 48 is troublesome for some other reason, the embodiment forms shown in FIGS. 24 to 26 and 27 can be selected. The main difference between this embodiment form and those shown in FIGS. 20 to 23 consists in that the projection 140 is relocated to the lower end of the dish 218 so that the padlock 48 has room to hang down freely. The lower end 65 of the actuating lever 228, with reference to the Figures, is bent away somewhat from the door leaf 14 and the dish and accordingly makes it easier to pull the actuating lever 228 out of its swiveled in position while at the same time actuating the hook device 158, which can be accomplished with one hand. Of course, this pulling out will only be carried out after the padlock 48 has been removed from the eyelet 142.

The eyelet 142 is designed in this case in such a way that it is formed by a projection 140 with a base 192 whose shape can be similar to that of the protrusion 188 in which the lock shaft 32 is supported, that is, with an external thread and, if required, two or four flattened portions, wherein a fastening nut 190 can be screwed onto the external thread so that the door leaf 14 is clamped between the fastening nut 190 and the dish 218. The dish 218 is held in turn by a ring 193 which is formed by the base 192 and is received in a corresponding recess 194 in the interior of the dish.

Figure 24:
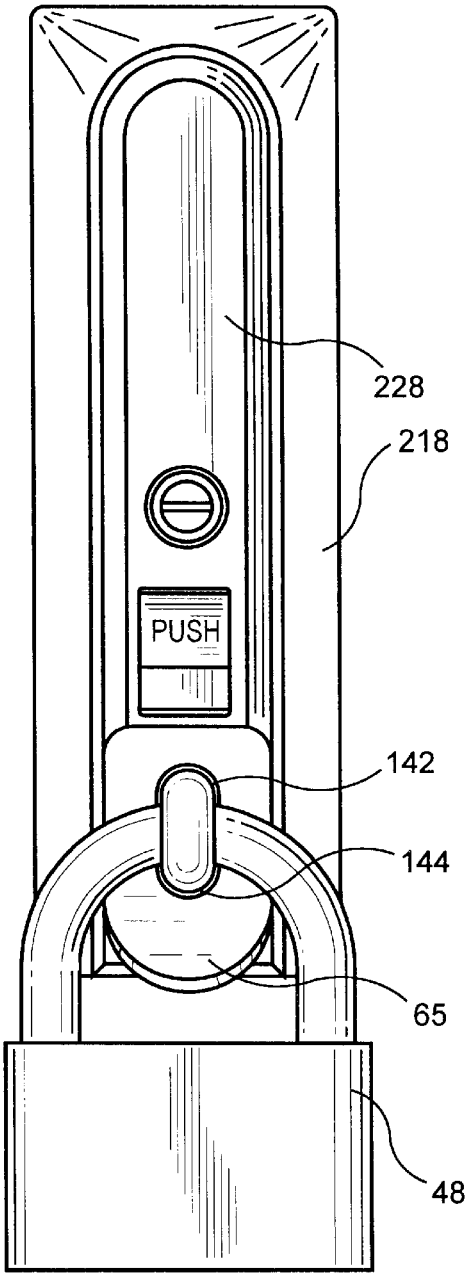
FIG. 24 shows a top view of another embodiment form of the swivel lever actuator constructed according to the invention.
Figure 25:
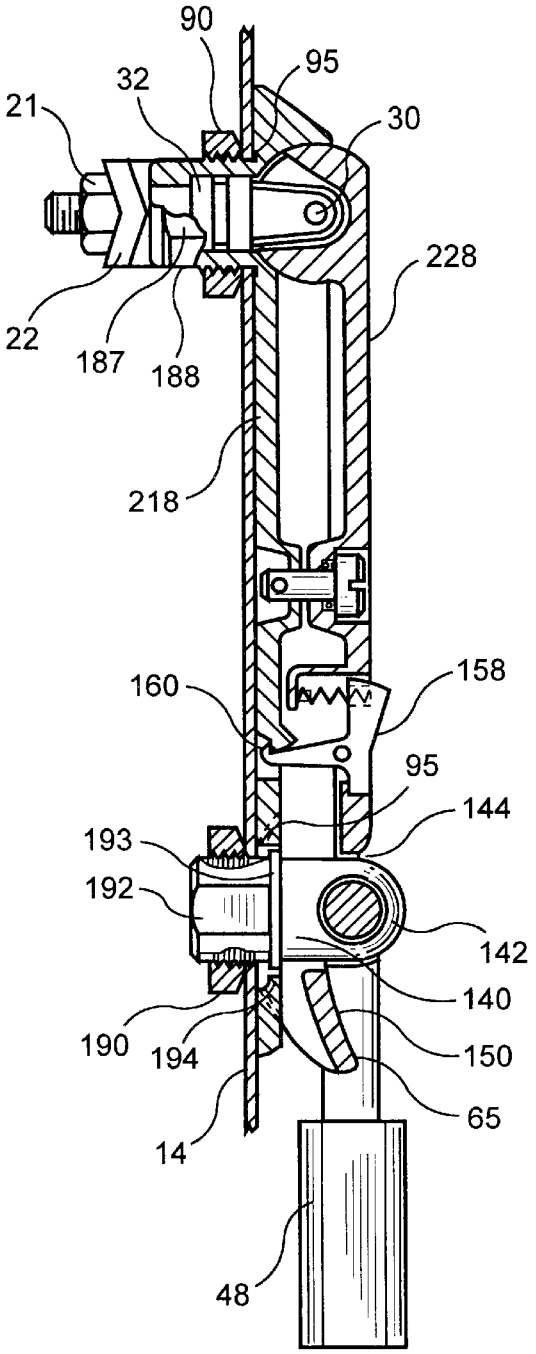
FIG. 25 shows a side view of the embodiment form according to FIG. 24 in section along the longitudinal axis.

The advantage of the construction shown in FIGS. 24 and 25 is, for one, the greater stability provided by fastening by means of two protrusions 188, 192 which project over the support surface of the dish and which are provided with a union nut 90 and 190, respectively, and, on the other hand, the fact that the padlock 48 does not project out as much.

Another advantage consists in that the closure can be used as a left-hand closure or a right-hand closure in case the openings for the protrusions are arranged symmetric to the center of the door. Similar advantages also apply to the embodiment forms in which two rectangular openings are provided.

It is noted that the inner area of the switch cabinet can be sealed relative to its outer area by means of sealing rings 95 between the outer surface of the door leaf and the dish in the area of the protrusions 188 and 192 insofar as the shaft 32, at which the hand lever actuator 228 is articulated at 30 and to which the sash 22 may be fastened by screws 21, is ouffitted with an O-ring seal 23.

Figure 27:
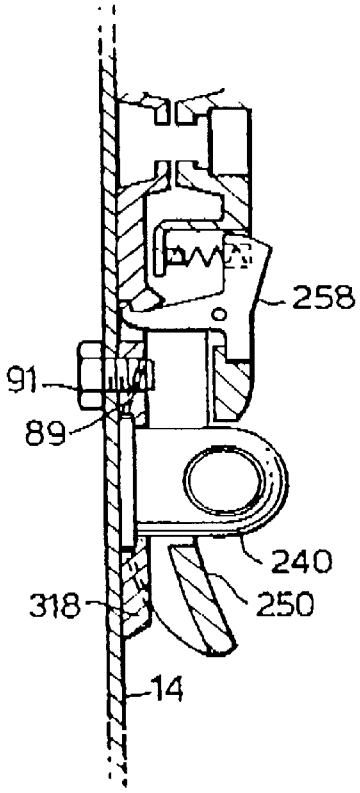
FIG. 27 shows a somewhat modified embodiment form compared with FIG. 25 in a partial sectional view.
Figure 28:
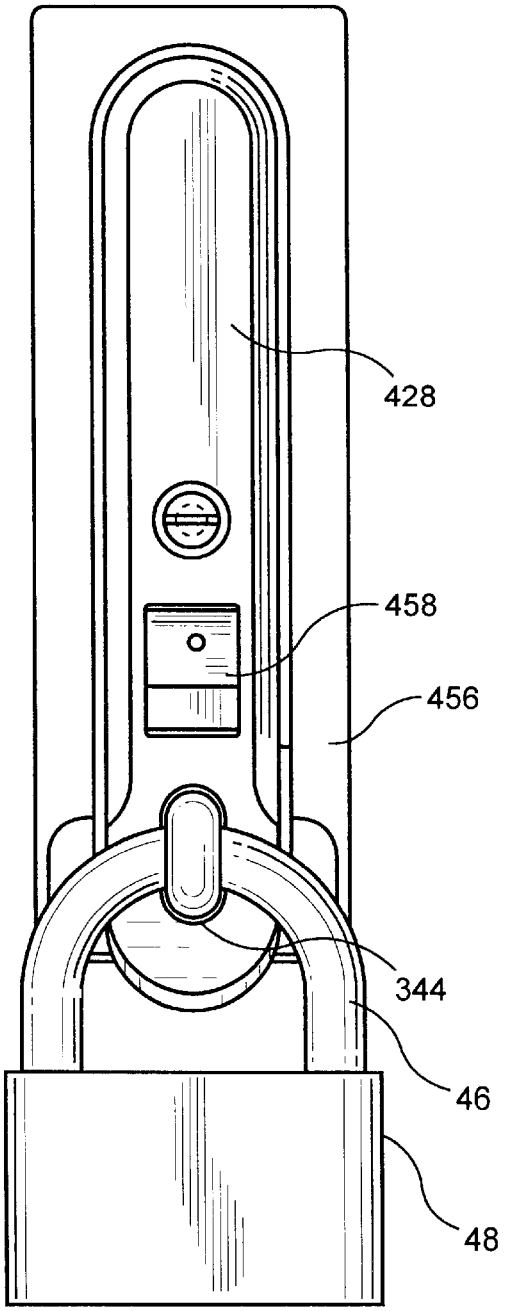
FIG. 28 shows a top view of a swivel lever actuator according to the invention in a different construction.
Figure 29:
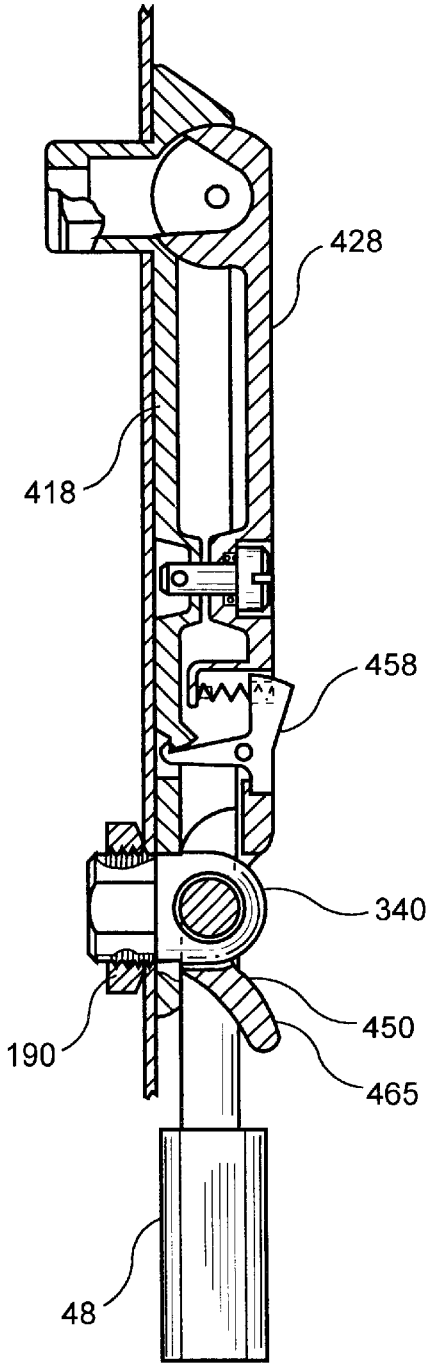
FIG. 29 shows a side view of the embodiment form according to FIG. 28 in section in longitudinal direction.
Figure 30:
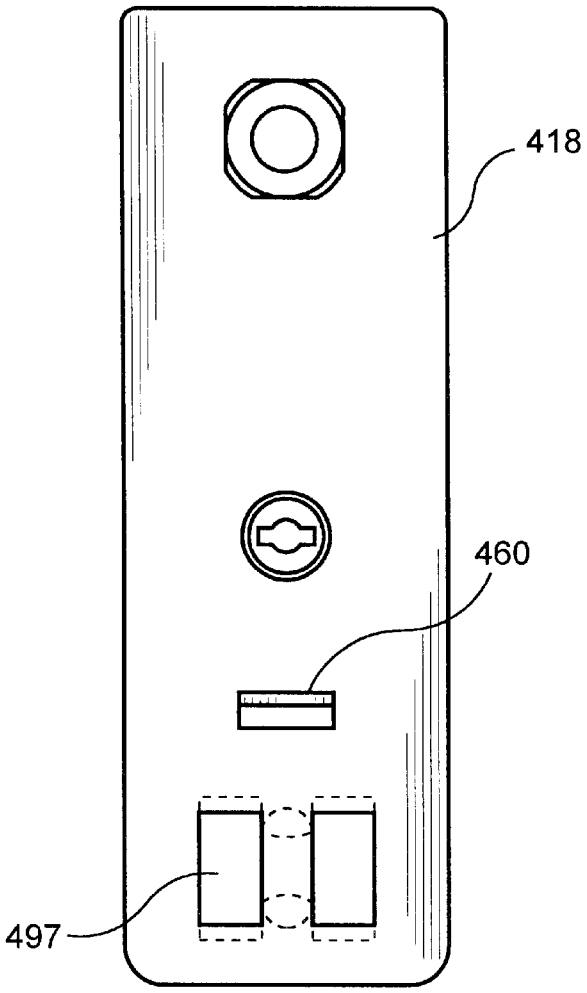
FIG. 30 shows a rear view of the dish according to FIG. 29.
Figure 31:
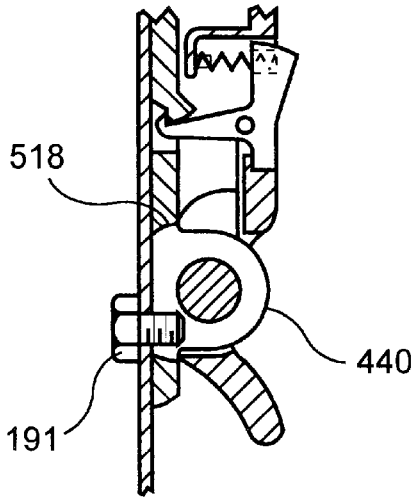
FIG. 31 shows a modification over FIG. 29.

FIG. 27 shows a somewhat modified embodiment form in which the projection 240 is supported by the dish 318 in a similar manner to the projection 40 according to FIG. 22 instead of by fastening with a union nut 90. The dish 318 itself is held at the upper end by a nut 90 similar to FIG. 26, but is held at its lower end by a screw bolt 91 which is arranged with its bolt head on the back of the door leaf 14 and whose threaded part extends into a corresponding threaded bore hole 89 inside the material of the dish 318.

While the eyelet of the protrusion 140 projects beyond the surface of the actuating lever 228 by a distance a in the embodiment forms in FIGS. 24 to 27, this is no longer the case in the present embodiment form shown in FIGS. 28 to 31. The projection 340 is shorter and accordingly makes it possible for the actuating lever 428 and the dish 418 to be recessed more deeply for the shackle of the padlock 48 than was the case in the preceding embodiment forms. Additional space is created in that the front area 465 of the actuating lever 428 extends into a recess 497 of the dish 418 and accordingly retains sufficient material strength. The upper area of the eyelet 340 accordingly no longer projects over the upper surface of the actuating lever 428.

The padlock 48 also remains below the alignment line of the front surface of the swiveled in actuating lever, resulting in an extremely flat embodiment form.

This extremely flat version is particularly well-suited to be arranged in flush paths because there are no projecting parts to impede persons passing by quickly. In this case, also, the end of the hand lever 428 projects out so that the actuating surface of the hook device 458 can be actuated and the actuating lever can be pulled out of its dish at the same time by one hand action.

The arrangement according to the invention can also be used in closures which are actuated already when the actuating lever is swiveled out of the dish, that is, which do not require subsequent turning of the swivel lever.

The invention can be applied commercially in switch cabinet construction.

While the foregoing description and drawings represent the present invention, it will be obvious to those skilled in the art that various changes may be made therein without departing from the true spirit and scope of the present invention.

What is claimed is:

1. A swivel lever actuator which can be secured in the swiveled in state for the closure of switch cabinet doors comprising:

a dish adapted to be arranged on an outer surface of the door and in which is arranged a driving device for the closure;

an actuating lever being articulated at the driving device so as to be swiveable out of the dish about an axis extending parallel to a supporting surface of the dish;

a hook device being arranged at the actuating lever and, when the actuating lever is swiveled in, engages with a back-engagement surface of the dish and accordingly holds the actuating lever in the swiveled in position;

a free end of the actuating lever projecting over the dish and having unlocking means with an actuating surface for the hook device, the actuating lever having an upper surface, the upper surface being formed to provide the actuating lever in its swiveled in state a substantially reduced height with respect to the outer surface of the door towards the free end of the actuating lever and said unlocking means adapted to being actuated by pressure directed away from the outer surface of the door.

2. The swivel lever actuator according to claim 1, wherein the unlocking movement of the hook device is carried out against spring force.

3. The swivel lever actuator according to claim 1, wherein a freewheeling device is provided between the hook device and a lever arrangement actuating the hook device.

4. The swivel lever actuator according to claim 1, wherein the actuating lever can be swiveled into the dish against spring force.

5. The swivel lever actuator according to claim 1, wherein the actuating lever also has a tool-actuated lock.

6. The swivel lever actuator according to claim 1, wherein the dish has two protrusions adapted to extend through a door leaf and wherein one protrusion forms a support for a lock shaft, while the other protrusion comprises the back-engagement surface for the hook device.

7. The swivel lever actuator according to claim 6, wherein the protrusions form circumferential threads on which fastening screw nuts can be screwed and wherein the door leaf may be clamped between the fastening screw nuts and the dish.

8. The swivel lever actuator according to claim 6, wherein the protrusions have a rectangular cross section and cover devices or lock case devices can be screwed on the latter and wherein the door leaf may be clamped between the cover devices or lock case devices and the dish.

9. The swivel lever actuator according to claim 1, wherein it is used for actuating at least one of a flat rod closure, a round rod closure, and a sash closure.

10. The swivel lever actuator according to claim 1, wherein the driving device for the closure is a tooth-wheel drive.

11. The swivel lever actuator according to claim 1, wherein the driving device for the closure is a lever drive.

12. The swivel lever actuator according to claim 1, wherein the driving device for the closure is a lock shaft.

* * * * *